US005771816A

United States Patent [19]

Zaguroli, Jr.

[11] Patent Number: 5,771,816

[45] Date of Patent: Jun. 30, 1998

[54] LIFT TABLE

[75] Inventor: James Zaguroli, Jr., Drayton Plains, Mich.

[73] Assignee: Knight Industries, Inc., Auburn Hills, Mich.

[21] Appl. No.: 329,219

[22] Filed: Oct. 26, 1994

[51] Int. Cl.[6] ..... A47B 9/00

[52] U.S. Cl. ..... 108/147; 248/631

[58] Field of Search ..... 108/144, 147, 108/145, 144.11; 248/631; 297/DIG. 8; 267/140.11

[56] References Cited

U.S. PATENT DOCUMENTS

| | | | |
|---|---|---|---|
| 2,942,834 | 6/1960 | Clark | 267/140.11 |
| 3,374,981 | 3/1968 | Stuckenberger et al. | 248/631 X |
| 3,682,431 | 8/1972 | Vivian | 248/631 |
| 3,989,232 | 11/1976 | Steinbach et al. | 248/631 X |
| 4,461,444 | 7/1984 | Grassl et al. | 248/631 X |
| 5,018,701 | 5/1991 | Olzaki et al. | 248/631 |
| 5,193,788 | 3/1993 | Richter et al. | 267/140.11 X |
| 5,199,690 | 4/1993 | Marshall | 248/631 X |
| 5,234,203 | 8/1993 | Smith | 248/631 X |
| 5,299,906 | 4/1994 | Stone . | |

*Primary Examiner*—Jose V. Chen
*Attorney, Agent, or Firm*—John R. Benefiel

[57] ABSTRACT

A lift table of the type having an air actuator bellows raising and lowering a load platform with a scissors linkage has an auxiliary expansible reservoir in fluid communication with the air bellows to improve the load-deflection characteristic. The auxiliary reservoir consists of an auxiliary bellows clamped between plates with an adjustable spring force.

8 Claims, 2 Drawing Sheets

LIFT TABLE

FIELD OF THE INVENTION

The present invention concerns self adjusting lift tables.

BACKGROUND OF THE INVENTION

Self adjusting lift tables or elevators consist of a load platform which is supported on a base by an air pressure actuator comprised of a heavy duty bellows containing compressed air. The bellows is reduced in height as weight is added to the platform by each successive part loaded onto the platform, causing the platform to be lowered. As a worker removes each part, the platform rises tending to keep the remaining parts at an easy accessible height during the entire unloading process.

The spring characteristic of the bellows can be adjusted to a limited degree by adjusting the air pressure in the bellows, so as to adapt the table to a variety of load weights.

Replaceable mechanical springs have also been employed to adapt to varying part weights, but this requires significant time and effort in changing the springs.

The air pressurized bellows spring characteristic is essentially nonlinear, as the pressure rises non linearly as weight is added.

In an effort to improve linearity, the effective volume of the bellows has been increased by connecting a fixed volume air reservoir. See U.S. Pat. No. 5,299,906 issued on Apr. 5, 1994, for a "Self Adjusting Pneumatic Load Elevator" for a description of such a lift table, in which the air in the reservoir augments the total volume of air in the system which is compressed by the load.

The fixed volume reservoir has the disadvantage that it is sometimes regarded as a pressure vessel, requiring testing and certification, increasing the cost of the equipment.

A problem has been encountered in adapting the adjustment feature to loaded parts of substantially differing densities. If a relatively dense part is being supported, the extent of deflection is desirably less than for a more bulky part so that the uppermost loaded parts remain at substantially the same height. Adjustment of the air pressure allows a change in stacking height of the table, but does not appreciably change the effective spring rate such that heavier loaded parts deflect the table the same as bulky parts, creating a mismatch in the degree of table deflection for one or both of the loaded parts.

While adding a fixed volume reservoir improves the load deflection linearity to some degree, there has still not been provided a satisfactory ability to tailor the load-deflection characteristic to various part densities to achieve a load-deflection curve matching a part weight and height.

Accordingly, it is an object of the present invention to provide a lift table of the type described in which the load deflection characteristic is improved, and is easily matched to various part densities.

SUMMARY OF THE INVENTION

This object, and other which will be appreciated upon a reading of the following specification and claims are achieved by the present invention, comprised of a lift table which is supported by an air actuator bellows as in conventional lift tables, but which has an auxiliary bellows in fluid communication with the load platform supporting bellows. The auxiliary bellows is adjustably compressed between a pair of spring loaded plates to variably increase the effective volume of the main actuator bellows to improve the load-deflection characteristic. The auxiliary reservoir provides a variable volume reservoir since the clamping plates are spring loaded to allow some expansion of the auxiliary volume, when the pressure in the main bellows is increased by an added loading.

The degree of spring loading is itself adjustable as the springs are each disposed on a respective one of a plurality of guide shafts passing through the clamping plates to allow adjusting movement towards or away from the sandwiched auxiliary bellows. This enables the effective spring rate of the system to be adjusted for a given air pressure and thus enables the deflection rate to be matched to a given part density.

In the described embodiment, the guide shafts are threaded at each end to allow the spring precompressing to be varied by threaded advance of nuts engaging each spring.

Thus, the combined effects of the main bellows, the auxiliary bellows and the spring preloading of the auxiliary bellows provides improved load-deflection characteristics as well as an improved adjustment capability.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 2:
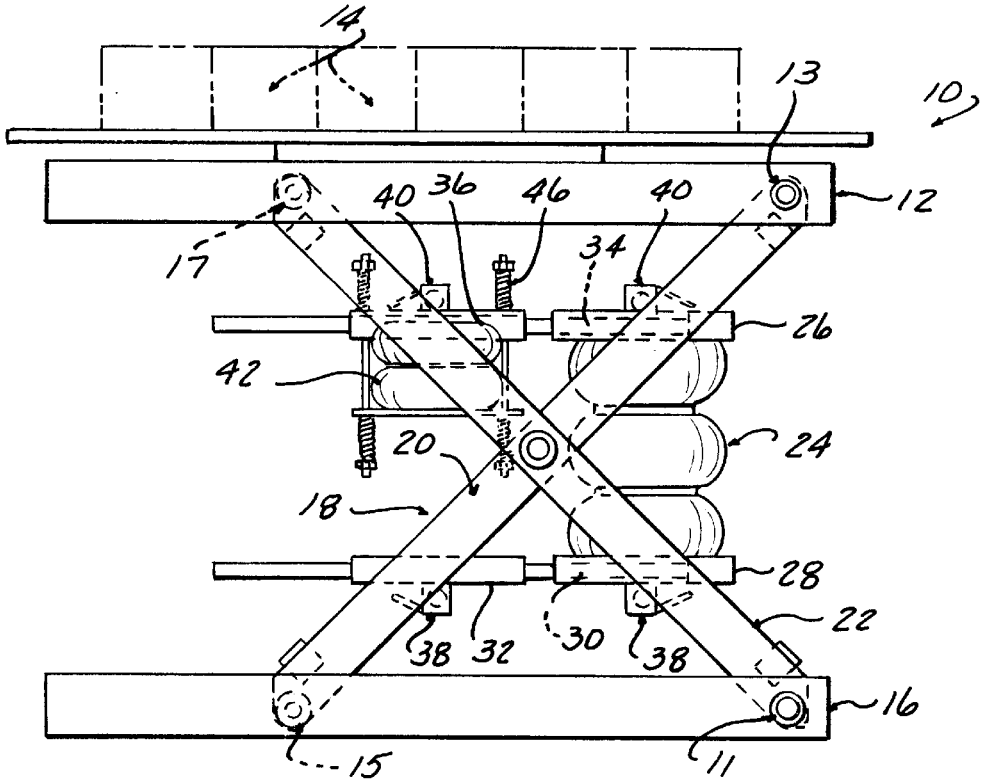
FIG. 2 is a side elevational view of the lift table shown in FIG. 1.
Figure 1:
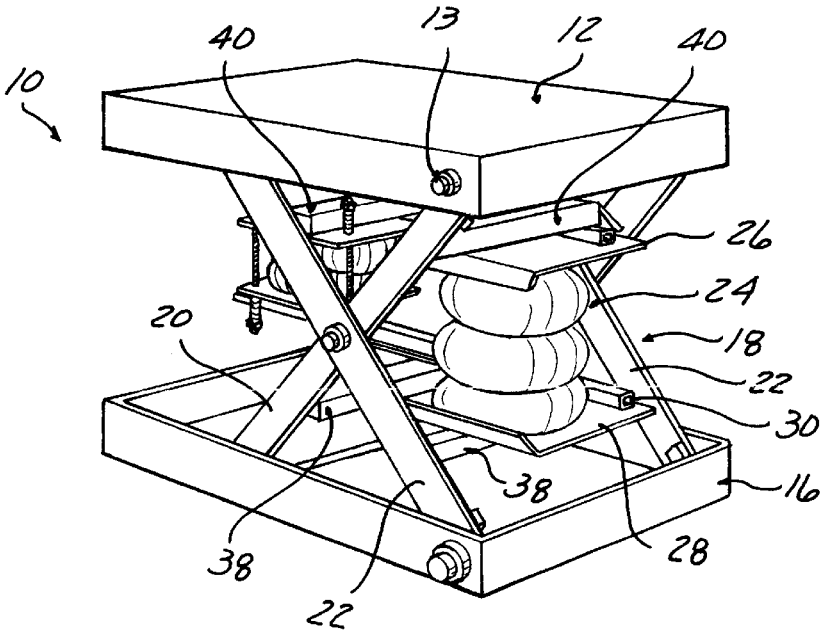
FIG. 1 is a perspective view of the improved lift table according to the invention.

Referring to FIGS. 1 and 2, the lift table 10 includes a planar load platform 12 adapted to receive parts 14 placed thereon.

The load platform 12 is supported on a base 16 by means of a pair of scissors linkages 18 so as to be able to be moved up and down. The scissors linkages 18 each includes pairs of elongated members 20, 22, provided on either side of the platform 12 and base 16, pinned together at their midpoint and are pivoted at 11, 13 at one of their ends 11, 13 to the platform 12 and base 16 respectively in conventional fashion.

The other end of each member 20, 22 is free to move on support rollers 15, 17 so that operation of the scissors linkages 18 can raise or lower the platform 12, in the manner described in U.S. Pat. No. 5,299,906.

The scissors linkages 18 are supported by air spring means defined by a compressible enclosure filled with a gas under pressure, here comprised of an air bellows actuator 24 precharged with air at a selected pressure. Such actuators are commercially available from Firestone under the "Airstroke" trademark. The bellows 24 is compressed between upper and lower bellows support pans 26, 28 supported on shafts 30 and 34 telescoped into tubes 32, 36, both fixed to respective upper and lower cross members 38, 40 in turn pivoted at either end to respective scissors members 20, 22 so as to be able to rotate. Extension of the shafts 20, 34 in the tubes 32, 36 and pivoting of cross members 38, 40 maintains the support pans 26, 28 level as the scissors action occurs during raising and lowering of the load platform 12.

Thus, as weight is added or removed from the load platform 12, the bellows is compressed or relaxed causing lowering or raising of the platform 12. Additional bellows may be added for heavier weight capacities.

Figure 3:
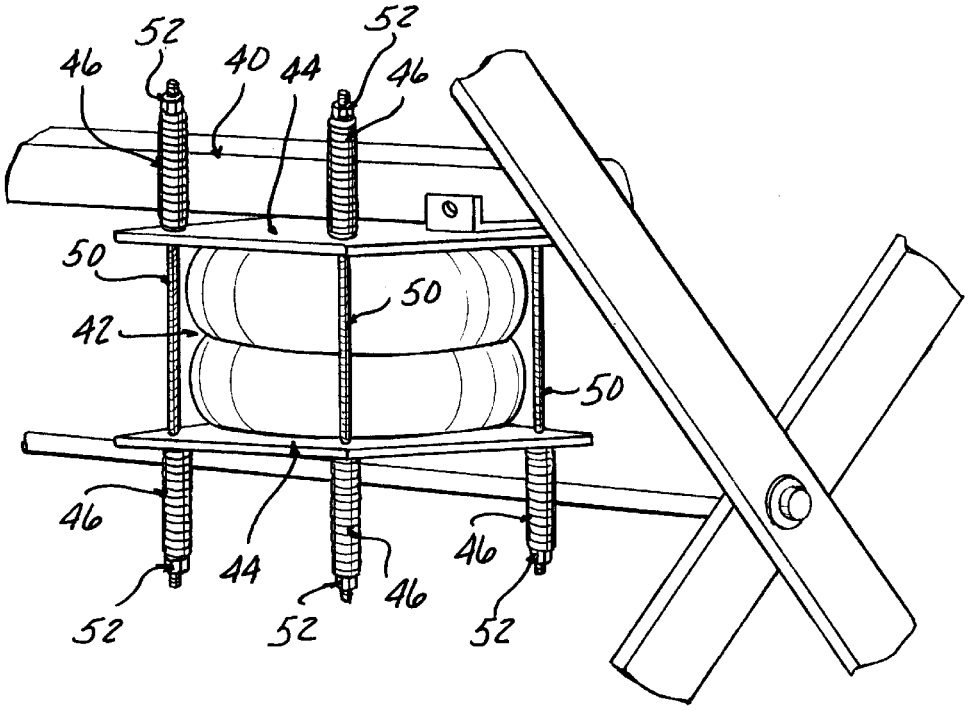
FIG. 3 is an enlarged fragmentary view of the auxiliary reservoir included in the lift table shown in FIGS. 1 and 2.

According to the concept of the present invention, an auxiliary adjustable rate air spring is provided, comprised of a smaller auxiliary bellows 42 supported beneath one of the upper cross members 40 compressed between a pair of clamping plates 44, as best seen in FIG. 3. The clamping plates 44 sandwich the auxiliary bellows 42 and exert a compressive force thereon generated by a series of helically wound mechanical compression springs 46 received over each end of threaded studs 50.

Studs 50 are located at each corner of the square clamping plates 44, passing through holes therein which allow free sliding movement of the clamping plates 44 towards and away from each other.

Lock nuts 52 are threaded on each end of each stud 50 and allow the compression of each spring 46 to be selectively varied to enable adjustment of the force exerted by the clamping plates 44 on the bellows 42.

Figure 4:
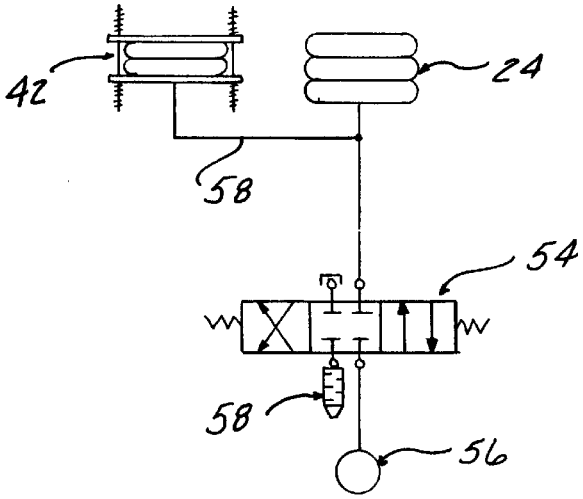
FIG. 4 is a simplified schematic diagram of the air circuit of the lift able according to the present invention.

The main bellows 21 can be precharged with air (or air bled therefrom) via a valve 54 (FIG. 4), connected to a shop air source 56 and to a vent 58. This enables the unloaded height of the lift table to be varied by changing the starting air pressure.

The auxiliary bellows 42 does not generate any lifting force on the load platform 12, but is connected via line 58 to the air pressure in the main bellows 24 so as to act as an auxiliary, variable volume reservoir. As the main bellows 24 is compressed, the air volume subject to this force includes the air in the auxiliary bellows 42. Thus, a slight increase in its volume will occur with a slight decrease in the enclosed volume of the main bellows 24.

By changing system air pressure, the unloaded height of the load platform 12 is varied. Changes in the level of spring force exerted by the springs 46 causes a variation in the effective spring rate of the bellows system. Thus, by loosening the nuts 52, the spring rate of the air system is lowered. Removal of less dense parts can thus be caused to create a relatively great deflection. By tightening the nuts 52, a greater spring rate results, so that denser parts will cause less deflection.

This arrangement thus allows convenient adjustment for different loading applications to achieve the objects of the invention.

I claim:

1. A lift table for supporting a number of load items at a variable height comprising:

a generally planar load platform adapted to receive load items thereon;

a base;

support means supporting said load platform above said base for up and down movement;

said support means including a main air spring containing a volume of compressed air and bearing the weight of said platform and load items to cause said platform to move downwardly on said base with increasing total weight of said load items; and, an auxiliary expandable reservoir in fluid communication with said main air spring and containing an air volume connected to said main air spring air volume, said auxiliary reservoir expansible under pressure but not bearing the weight of said platform or load items so that said auxiliary reservoir is not compressed thereby;

whereby a compressibility of said main air spring corresponds to a total air volume of said main air spring and said auxiliary air reservoir, but only the main air spring is compressed by the weight of said platform and load items.

2. The lift table as claimed in claim 1 wherein said main air spring comprises a main bellows and said auxiliary air reservoir comprises an auxiliary bellows connected to said main bellows.

3. The lift table as claimed in claim 2 further including a pair of clamping plates sandwiching said auxiliary bellows, and means for exerting a compressive force acting to resiliently resist expansion of said auxiliary bellows by compression of said main bellows.

4. The lift table as claimed in claim 3 wherein said means comprises a series of springs adjustably compressed against the outside of each clamping plate to generate said compressive force.

5. The lift table as claimed in claim 4 further including a series of threaded studs passing through said clamping plates to have a protruding end on the outside of each clamping plate, a helically wound compression spring on each stud protruding end, and an adjustment nut threaded on each stud end compressing a respective coil spring.

6. The lift table as claimed in claim 1 wherein said support means further includes a scissors linkage interconnecting said load platform and said base.

7. A method of supporting a load of parts on a platform so as to cause said platform to rise with removal of each part or fall with adding a part, comprising the steps of mounting a readily compressible main enclosure filled with a gas so that said main enclosure is loaded with the weight of said platform and said parts;

connecting the interior of said enclosure with the interior of an auxiliary reservoir, said reservoir being expansible by the gas pressure thereby communicated from said main enclosure to said auxiliary reservoir; and, resiliently exerting an adjustable compressive force on the exterior of said auxiliary reservoir to vary an expandability of said auxiliary reservoir by the exertion of said gas pressure communicated from said main enclosure so as to cause a variation in the vertical movement of said platform caused by removing or adding a part onto said platform.

8. The method of claim 7 wherein in said step of resiliently exerting an adjustable compressive force on said auxiliary reservoir, said force is increased for supporting denser parts and decreased for supporting less dense parts, whereby platform movement increases for less dense parts and decreases for denser parts.

* * * * *